United States Patent [19]

Atkins

[11] 4,174,046

[45] Nov. 13, 1979

[54] PALLET FRAMES

[75] Inventor: George T. N. Atkins, Macclesfield, England

[73] Assignee: Palletower Limited, Macclesfield, England

[21] Appl. No.: 889,698

[22] Filed: Mar. 24, 1978

[30] Foreign Application Priority Data

May 16, 1977 [GB] United Kingdom ..... 20541/77

[51] Int. Cl.[2] ..... B65D 19/10; B65D 7/20

[52] U.S. Cl. ..... 220/6; 206/386; 206/600; 220/19

[58] Field of Search ..... 206/386, 600; 220/6, 220/19

[56] References Cited

U.S. PATENT DOCUMENTS

| | | | |
|---|---|---|---|
| 2,735,569 | 2/1956 | Averill | 206/600 |
| 3,254,786 | 6/1966 | Melville | 220/6 |
| 3,327,889 | 6/1967 | Dore | 220/6 |
| 3,348,923 | 10/1967 | Wilson | 220/6 |

*Primary Examiner*—William T. Dixson, Jr.

*Attorney, Agent, or Firm*—Townsend and Townsend

[57] ABSTRACT

A pallet frame of the collar converter kind, that is a frame structure having interconnected side walls of low height and elongated form adapted to fit around the periphery of a load supporting surface, has the side walls thereof formed as openwork structures from elongated metal members.

7 Claims, 1 Drawing Figure

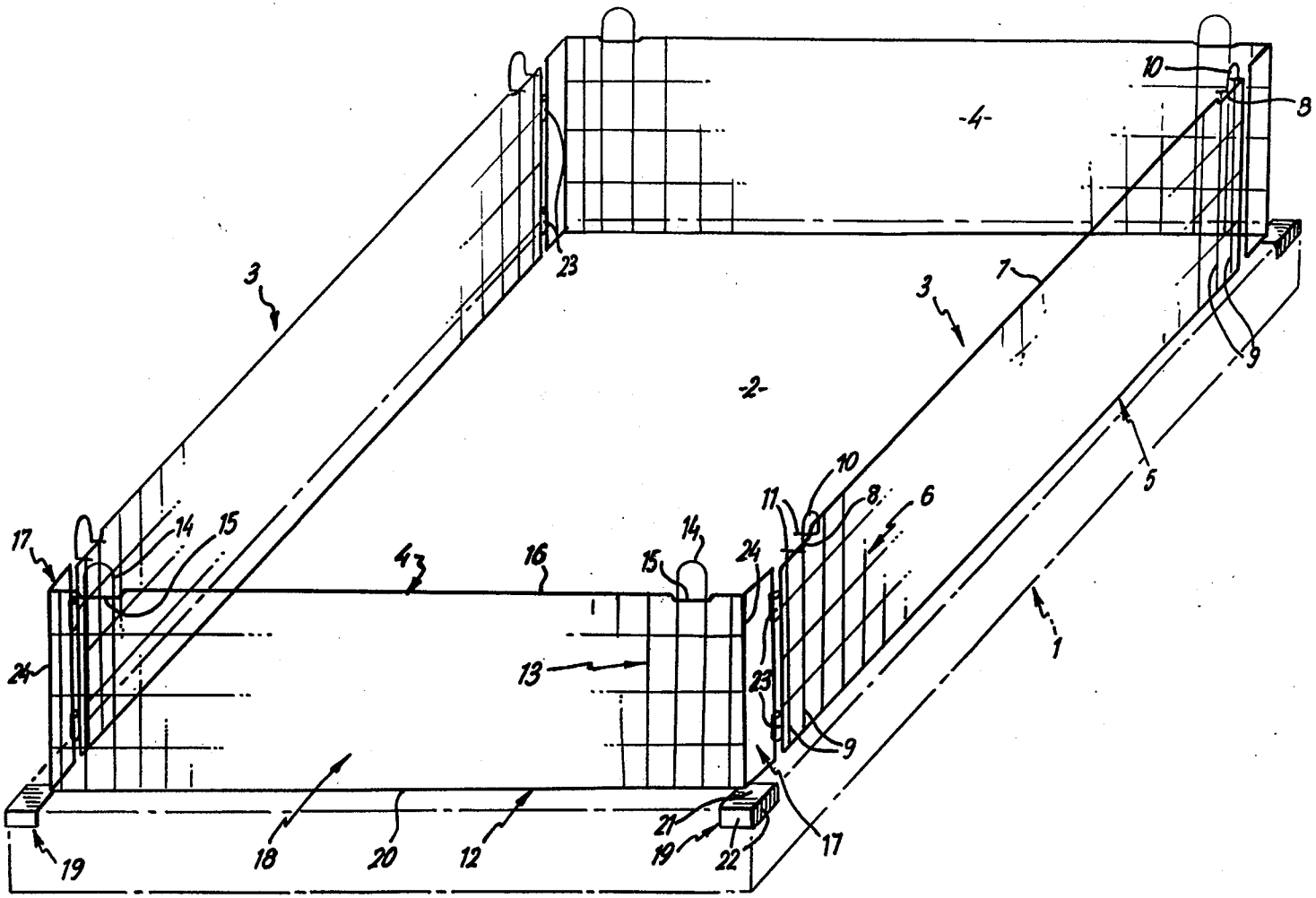
1
2
3
4
5
6
7
8
9
10
11
12
13
14
15
16
17
18
19
20
21
22
23
24

PALLET FRAMES

This invention relates to pallet frames of the kind known as collar converters by which is meant a frame structure adapted to fit around the periphery of a load supporting surface and having interconnected side walls each adapted to extend upwardly at a respective side of said surface, each said side wall being of elongated form in that its height is a minor proportion of the transverse dimension thereof which extends in use parallel to the respective side of said surface.

A known collar converter for use with four-sided pallets comprises four elongated wooden boards which are hingedly interconnected with each other at their ends so as to define a structure which is adjustable, by pivoting of the boards relative to each other about the hinge joints, between a collapsed state in which two of the boards lie flat on top of the other two boards, and an erected state in which the structure has the form of a four-sided rectangular frame. In the collapsed state the converter can be conveniently stored. In the erected state the frame can seat around the periphery of a pallet resting on the top surface of same, and the converter can be used for supporting a further pallet or a further like converter in spaced disposition above the first said pallet.

With this known arrangement, having regard to the use of wooden boards for the side walls of the frame structure, the converter may be heavy, may lack durability and obstructs view of loads supported on a pallet on which the converter is seated. These disadvantages are particularly troublesome in the case where a plurality of converters, or a plurality of pallets with converters, are stacked on top of each other.

An object of the present invention is to provide a collar converter with which the above mentioned disadvantages can be avoided or at least minimised.

According to the present invention therefore there is provided a collar converter as hereinbefore defined, characterised in that each said wall comprises an openwork structure formed from elongated metal members.

With this arrangement it will be readily appreciated that it is possible to achieve a strong, rigid frame which need not unduly obstruct view of loads within the frame and which need not have a great weight. Further, by appropriate formation of the frame, good durability and attractive appearance may be achieved.

Most preferably, each side wall is formed from a peripheral framework made from metal rods or bent metal wire, and a metal mesh, or arrangement of metal rods or sheet material or the like is secured across said framework. Alternatively or additionally, at least one said wall may have a peripheral framework and an openable central gate structure to provide easy access to the interior of the frame.

Preferably also, the said walls are permanently or detachably interconnected via hinge joints whereby the converter can be folded flat for storage purposes when not in use. Alternatively, if desired, other forms of permanent or detachable interconnection may be employed.

The interconnection between the said walls may be at the corners of the frame. If desired however, one or more side walls may be shaped to define a corner at one or both ends thereof whereby the interconnection with the adjacent side wall at such end is at a position spaced from the corner. This arrangement can facilitate folding flat of the converter.

A lower part of the converter, preferably the lower edge of each said wall, may be arranged to seat on the upper surface of a pallet or other load supporting platform and means may be provided for locating the converter relative to the platform. Said means may comprise downwardly projecting elements which extend alongside the platform. Most conveniently said elements are provided at corners of the converter and fit around corners of the platform. Additionally or alternatively one or more side walls may have a latch or cleat which extends downwardly and is adapted to fit beneath an upper load supporting surface of the platform to prevent lifting of the converter away from the platform. Said latch or cleat may be hinged so that it can be moved into and out of engagement with the platform when the converter is seated thereon.

An upper part of the converter, preferably the upper edge of each said wall, or of some of the said walls, may be adapted to define a seat for a further pallet or converter, and means may be provided for locating said further pallet or converter relative thereto. Said means may comprise upstanding lugs or the like which are arranged to fit alongside said further converter or pallet.

The invention will now be described further by way of example only and with reference to the accompanying drawing which is a diagrammatic perspective view of one form of a collar converter according to the invention.

The collar converter is for use with a standard four-sided wooden pallet 1 having an upper rectangular load supporting surface 2 of dimensions 1000 × 1200 mm. In use, the converter is erected so as to adopt the form of a rectangular frame and seats on said upper surface 2 around the periphery of same.

The converter is formed from four interconnected openwork structures: two like side structures 3 and two like end structures 4.

Each side structure 3 comprises a peripheral framework 5 of generally rectangular form formed from bent and welded metal wire. The height of the framework, that is, the maximum spacing of the long sides thereof, is 280 mm. Across the framework 5 there is welded, on the inner side of the framework, a metal mesh structure 6 formed from vertical and horizontal metal wires or rods. The wire forming the top long edge 7 of the framework 5 is bent downwardly at portions 8 adjacent each end thereof and a respective pair of vertical wires 9 of the mesh structure 6 are formed integrally and project upwardly beyond each downwardly bent end portion 8 to define an upwardly projecting lug 10 in the form of a wire loop. The wires 9 are stepped so that the loop 10 extends at the outer side of the framework 5 and the wires 9 have horizontal portions 11 which overlie the respective end portion 8 and thereby extend substantially level with the central portion of the top wire 7.

Each end structure 4 also comprises a peripheral wire framework 12 of height 280 mm with a metal mesh structure 13 welded to the inner side thereof, and, as with the side structures 3, outwardly displaced lugs 14 in the form of wire loops projecting above downwardly displaced portions 15 of the top wire 16 of the framework 12 at positions adjacent to but spaced from each end thereof. Unlike the side structures 3, however, each end structure 4 is not a flat structure but has short end portions 17 which are bent at right angles to the main central portion 18 of end structure 4. The mesh structure 13 extends only over the central portion 18 and not over the end portions 17. Reinforcing wires 24 are welded between the upper and lower wires 16, 20 at the corners.

Metal corner brackets 19 are welded to the bottom wire 20 of the end structure 4 at each corner between the central portion 18 and the end portion 17. Each bracket 19 is a sheet metal box structure having a top wall 21 and two adjacent side walls 22.

The end structures 4 are permanently connected to the two side structures 3 via hinge joints defined by sleeves 23 fitting around adjacent end wires of the structures 3, 4.

In use, as can be seen in the drawing, the converter rests on the pallet top surface 2 with the bottom wires of the four structures 3, 4 engaging said surface 2 slightly inwardly of the peripheral edges thereof. The central portions 18 of the end structures 4 define opposite end walls of the converter and the side structures in combination with the end portions of the end structures define opposite side walls.

The converter is located horizontally relative to the pallet by means of the corner brackets which fit around the pallet corners.

A further pallet can fit on top of the converter with the lower peripheral surface thereof resting on the top wires of the four structures. The lugs act to hold such upper pallet in position horizontally.

Alternatively a further like converter can fit on top of the first said converter in which case the corner brackets 19 rest on top of the upper corners in the top wires 16 of the end structures 4.

It will be appreciated that any desired number of converters or converters and pallets may be stacked on top of each other. The ability to stack converters on converters as well as being able to stack converters on pallets and pallets on converters affords a particularly advantageous versatility. It is to be understood that conventional wooden collars are not so readily versatile.

With such a stack, great rigidity and stability can be achieved, the weight of upper pallets and/or converters being supported securely and evenly in so far as loads are transmitted evenly down the stack via the peripheral frameworks 5, 12 of the converter structures 3, 4 to the bottom wires of the bottom converter which transmit the loading evenly around the periphery of the top surface of the bottom pallet.

Further, it will be appreciated that the openwork structure of the converters ensures that loads within the converters can be readily inspected. Still further, the converters can be durable and of attractive appearance.

When not in use, the converter can be readily folded flat by pivoting of the structures 3, 4 about the hinge joints 23. The mesh structures 6, 13 are on the inner sides of the frameworks 5, 12 whereby advantageously the wires do not project outwardly which could give rise to snagging problems. This inward arrangement of the mesh structures 6, 13 does not restrict folding flat of the converter due to the bent end portions 17 of the end structures 4.

It is of course to be understood that the invention is not intended to be restricted to the details of the above embodiment which are described by way of example only. Thus, for example, if desired the converter may have one or more of the side and end structures which defines, in use, in an openable or detachable gate to provide access to the interior of the converter. Further, instead of or additional to the downwardly directed corner brackets 19–22, there may be provided for location relative to the bottom pallet downwardly directed strips or flanges or wire loops at the bottom edges of the structures 3, 4.

What is claimed is:

1. A collar converter of the kind comprising a frame structure adapted to fit around the periphery of a load supporting surface and having interconnected side walls each adapted to extend upwardly at a respective side of said surface, each said side wall being of elongated form in that its height is a minor proportion of the transverse dimension thereof which extends in use parallel to the respective side of said surface, and each said wall comprising an openwork structure formed from elongated metal members, said side walls all being interconnected by hinge joints such that the frame structure can be folded flat for storage when not in use, a lower part of the converter being arranged to seat in use on said load supporting surface and having downwardly projecting elements which extend alongside the load supporting surface for locating the converter transversely relative to said surface and an upper part of the converter being adapted to define a seat for alternatively receiving another, upper pallet or another upper converter and having upwardly projecting elements arranged to fit alongside said upper converter or upper pallet for locating the converter transversely related to said upper pallet or upper converter.

2. A converter according to claim 1 wherein said openwork structure of each said side wall comprises a peripheral framework of said elongated metal members.

3. A converter according to claim 1 wherein at least one of said side walls is shaped to define a corner at at least one end thereof whereby the interconnection with the adjacent side wall at such end is at a position spaced from the corner.

4. A converter according to claim 1 wherein said downwardly projecting elements are located at corners of the converter and are arranged to fit around corners of the said load supporting surface.

5. A converter according to claim 1, wherein said side walls are shaped so that they define corners and including two upwardly projecting elements for each corner of the said upper pallet or upper converter arranged to fit at opposite sides of said corner.

6. A converter according to claim 1, wherein there are two pairs of opposite side walls, and each side wall of one said pair is shaped to define a corner at both ends thereof whereby all said hinge joints are spaced from the corners.

7. A collar converter of the kind comprising a frame structure adapted to fit around the periphery of a load supporting surface and having interconnected side walls each adapted to extend upwardly at a respective side of said surface, each said side wall being of elongated form in that its height is a minor proportion of the transverse dimension thereof which extends in use parallel to the respective side of said surface, and each said wall comprising an openwork structure formed from elongated metal members, said side walls all being interconnected by hinge joints such that the frame structure can be folded flat for storage when not in use, the side walls defining two pairs of opposite side walls, each side wall of one said pairs being shaped to define a corner at both ends thereof whereby all said hinge joints are spaced from the corners.

* * * * *

UNITED STATES PATENT AND TRADEMARK OFFICE

CERTIFICATE OF CORRECTION

PATENT NO. : 4,174,046

DATED : November 13, 1979

INVENTOR(S) : George T. N. Atkins

It is certified that error appears in the above-identified patent and that said Letters Patent are hereby corrected as shown below:

Prior Art Reference on data sheet listed as U.S. Patent 3,348,923 should be listed as 3,348,723.

Claim 6, line 1, (column 4, line 47), change "1" to --3--.

Signed and Sealed this

*Twenty-ninth* Day of *April 1980*

[SEAL]

*Attest:*

SIDNEY A. DIAMOND

*Attesting Officer*

*Commissioner of Patents and Trademarks*